US008438852B2

(12) United States Patent
Valeev et al.

(10) Patent No.: US 8,438,852 B2
(45) **Date of Patent: *May 14, 2013**

(54) ANNULAR RING-MANIFOLD QUATERNARY FUEL DISTRIBUTOR

(75) Inventors: Almaz Valeev, Kazan (RU); Chunyang Wu, Greer, SC (US); Leonid Borisovich Zvedenuk, Moscow Region (RU)

(73) Assignee: General Electric Company, Schenectady, NY (US)

( * ) Notice: Subject to any disclaimer, the term of this patent is extended or adjusted under 35 U.S.C. 154(b) by 16 days.

This patent is subject to a terminal disclaimer.

(21) Appl. No.: 12/754,803

(22) Filed: Apr. 6, 2010

(65) Prior Publication Data

US 2011/0239653 A1 Oct. 6, 2011

(51) Int. Cl.
*F23R 3/36* (2006.01)

(52) U.S. Cl.
USPC ..... 60/739; 60/747; 60/804

(58) Field of Classification Search ..... 60/739, 60/804, 747, 737, 746, 748
See application file for complete search history.

(56) References Cited

U.S. PATENT DOCUMENTS

| | | | | |
|---|---|---|---|---|
| 2,552,851 | A | 5/1951 | Gist | |
| 2,720,081 | A * | 10/1955 | Tutherly | 60/737 |
| 2,862,359 | A | 12/1958 | Spears, Jr. | |
| 2,920,449 | A | 1/1960 | Johnson et al. | |
| 3,102,392 | A | 9/1963 | Bauger et al. | |
| 3,768,251 | A | 10/1973 | Camboulives et al. | |
| 4,170,111 | A | 10/1979 | Lewis et al. | |
| 4,499,735 | A | 2/1985 | Moore et al. | |
| 4,862,693 | A | 9/1989 | Batakis et al. | |
| 5,168,698 | A | 12/1992 | Peterson et al. | |
| 5,231,833 | A | 8/1993 | MacLean et al. | |
| 5,259,184 | A * | 11/1993 | Borkowicz et al. | 60/39.55 |
| 5,321,949 | A | 6/1994 | Napoli et al. | |
| 5,359,847 | A | 11/1994 | Pillsbury et al. | |
| 5,361,586 | A | 11/1994 | McWhirter et al. | |
| 5,901,555 | A | 5/1999 | Mandai et al. | |
| 5,937,653 | A | 8/1999 | Alary et al. | |
| 5,983,642 | A | 11/1999 | Parker et al. | |
| 6,109,038 | A | 8/2000 | Sharifi et al. | |
| 6,282,904 | B1 | 9/2001 | Kraft et al. | |
| 6,397,602 | B2 * | 6/2002 | Vandervort et al. | 60/737 |
| 6,446,439 | B1 | 9/2002 | Kraft et al. | |
| 6,513,334 | B2 | 2/2003 | Varney | |
| 7,080,515 | B2 | 7/2006 | Wasif et al. | |
| 7,137,256 | B1 | 11/2006 | Stuttaford et al. | |
| 7,249,461 | B2 | 7/2007 | Moraes | |
| 7,966,820 | B2 * | 6/2011 | Romoser | 60/742 |

(Continued)

OTHER PUBLICATIONS

L.B. Davis et al, "Dry Low NOx Combustion Systems for GE Heavy-Duty Gas Turbines", GER-3568G, Oct. 2000, pp. 9-12.*

(Continued)

*Primary Examiner* — William H Rodriguez
*Assistant Examiner* — Carlos A Rivera
(74) *Attorney, Agent, or Firm* — Cantor Colburn LLP

(57) ABSTRACT

A combustor section is provided and includes one or more annular quaternary fuel manifolds mounted within an annular passage defined between a casing and a cap assembly of a combustor through which air and/or a fuel/air mixture flows upstream from a fuel nozzle support, the manifold including a body to accommodate quaternary fuel therein, the body defining injection holes through which the quaternary fuel is injected into a section of the passage at a location upstream from the fuel nozzle support.

11 Claims, 4 Drawing Sheets

U.S. PATENT DOCUMENTS

| | | | | |
|---|---|---|---|---|
| 2002/0020173 | A1 | 2/2002 | Varney | |
| 2002/0078690 | A1 | 6/2002 | Stuttaford et al. | |
| 2002/0174657 | A1 | 11/2002 | Rice et al. | |
| 2009/0077972 | A1* | 3/2009 | Singh | 60/737 |
| 2009/0223228 | A1* | 9/2009 | Romoser | 60/776 |
| 2011/0061395 | A1 | 3/2011 | Kendrick | |

OTHER PUBLICATIONS

Non-Final Office Action dated Jan. 12, 2012 for U.S. Appl. No. 12/754,813.

* cited by examiner

ANNULAR RING-MANIFOLD QUATERNARY FUEL DISTRIBUTOR

CROSS REFERENCE TO RELATED APPLICATIONS

The present application is hereby cross-referenced with co-pending application entitled "Segmented Annular Ring-Manifold Quaternary Fuel Distributor," the entire contents of which are incorporated herein by reference.

BACKGROUND OF THE INVENTION

The subject matter disclosed herein relates to gas turbine combustors, and particularly to an annular ring-manifold quaternary fuel distributor, which is used to mitigate combustor instability, to provide better fuel/air mixing and improve flame holding margin of downstream fuel nozzles by accommodating up to 30%, by mass, of total combustor fuel.

Existing quaternary fuel pegs of a combustor are installed through the flow sleeve casing inner wall of, for example, combustors of gas turbine engines and are located in the annulus between the flow sleeve and cap barrel, which are upstream of combustor fuel nozzles. Their main function is to inject fuel into the flow of air or a fuel/air mixture and to mitigate combustion dynamics in and through the combustor during combustion operations.

The existing quaternary peg design is susceptible, however, to instances of flame-holding, which refers to the phenomena of unexpected flame occurrence immediately downstream of the quaternary pegs within combustors. Flame-holding can lead to damage to combustor hardware. The existing design also tends to generate relatively unsatisfactory quaternary fuel air mixing, which limits the capability to accommodate high quaternary fuel mass fraction, leading to unsatisfactory or limited quaternary fuel-air pre-mixing upstream combustor fuel nozzles.

BRIEF DESCRIPTION OF THE INVENTION

According to an aspect of the invention, a combustor section is provided and includes one or more annular quaternary fuel manifolds mounted within an annular passage defined between a casing and a cap assembly of a combustor through which air and/or a fuel/air mixture flows upstream from a fuel nozzle support, the manifold including a body to accommodate quaternary fuel therein, the body defining injection holes through which the quaternary fuel is injected into a section of the passage at a location upstream from the fuel nozzle support.

According to another aspect of the invention, a combustor section is provided and includes a casing, a cap assembly, having a fuel nozzle support formed therein, the cap assembly being disposed within the casing to define an annular passage between the casing and the cap assembly along which air and/or a fuel/air mixture flows upstream from the fuel nozzle support and one or more annular manifolds mounted within a section of the passage at which the air and/or the fuel/air mixture flows upstream from the fuel nozzle support, each manifold including a body to accommodate quaternary fuel therein, the body defining injection holes through which the quaternary fuel is injected into the passage section.

According to yet another aspect of the invention, an annular fuel manifold of a combustor is provided and includes a casing and a cap assembly, having a fuel nozzle support formed therein, disposed within the casing to define an annular passage along which air and/or a fuel/air mixture flows upstream from the fuel nozzle support, the annular fuel manifold including an annular body formed to accommodate quaternary fuel therein and to define fuel injection holes by which the quaternary fuel is injected into a section of the passage at which the air and/or the fuel/air mixture flows upstream from the fuel nozzle support.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects of the invention, one or more concentric annular ring-shaped manifolds may be installed within, for example, a combustor of a gas turbine engine, upstream of combustor fuel nozzles, for promoting and structurally supporting substantially uniform distribution of quaternary fuel injection locations to thus improve fuel and air mixing. Such manifolds may be able to handle relatively large quaternary fuel mass fractions (i.e., about 30%, of total system fuel on a mass basis), reduce flame-holding occurrence downstream including the quaternary fuel injection region and areas near the downstream combustor fuel nozzles, and may contribute to reducing NOx emissions and combustion instabilities.

Figure 1:
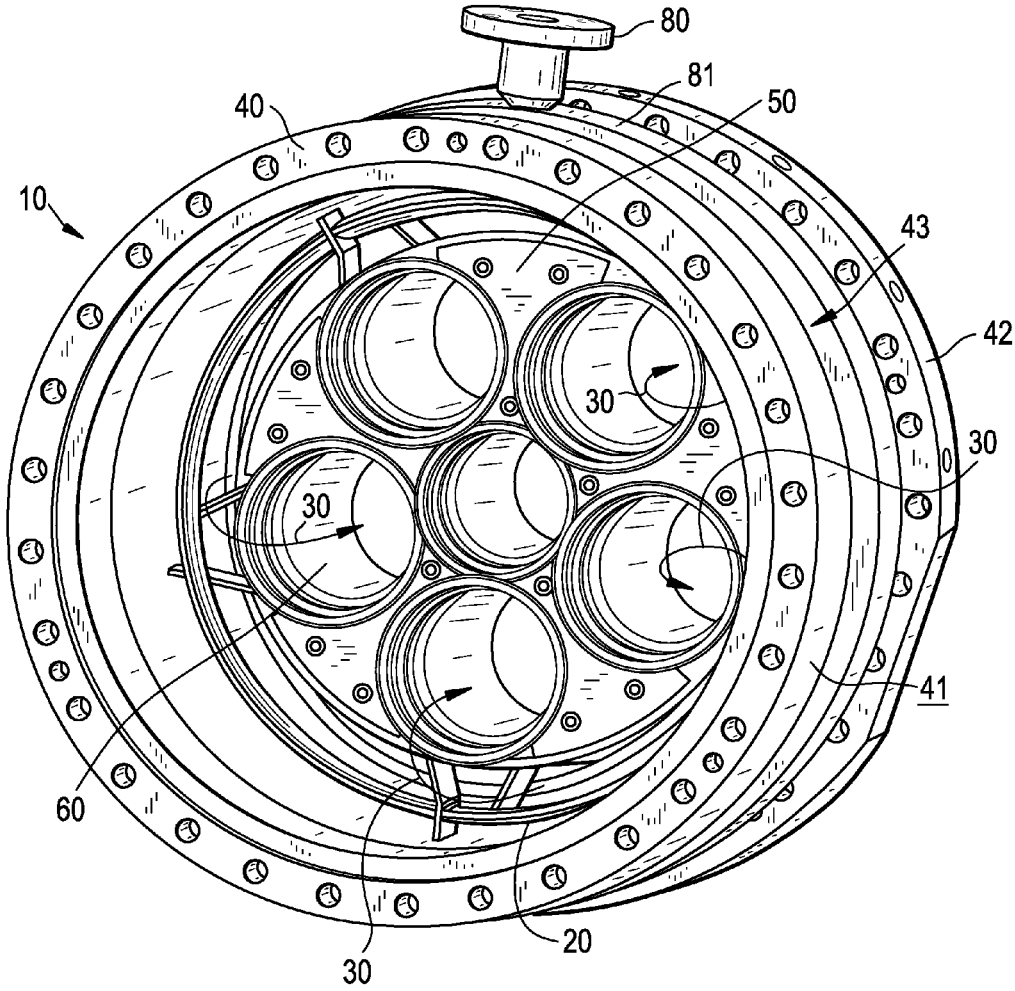
FIG. 1 is a perspective downstream view of a combustor section including a casing and a cap assembly with an end cover removed for clarity.

With reference to FIG. 1, a combustor section 10 is provided and includes an annular manifold 20 that is mounted within an annular passage 30, which is defined between a casing 40 and a cap assembly 50. The casing 40 includes first and second casing flanges 41 and 42 and a quaternary fuel distribution manifold 43. The quaternary fuel distribution manifold 43 is axially interposed between the first and second casing flanges 41 and 42. The cap assembly 50 is formed with a plurality of fuel nozzle supports 60 in which combustor fuel nozzles may be located. Air and/or a fuel air mixture flows through the annular passage 30 and may eventually pass through combustor fuel nozzles, which would be located at the fuel nozzle supports 60.

Figure 2:
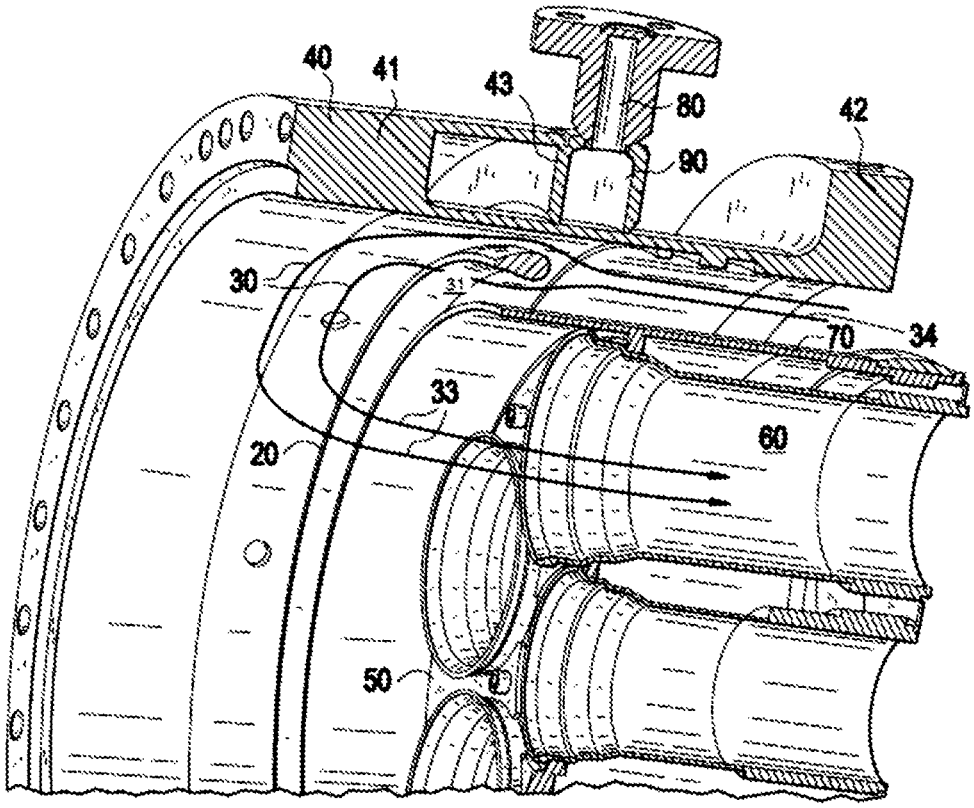
FIG. 2 is an enlarged perspective view of a portion of the combustor of FIG. 1, highlighting a quaternary fuel distribution manifold, a ring manifold, and the annulus formed by the casing and the cap assembly.
Figure 3:
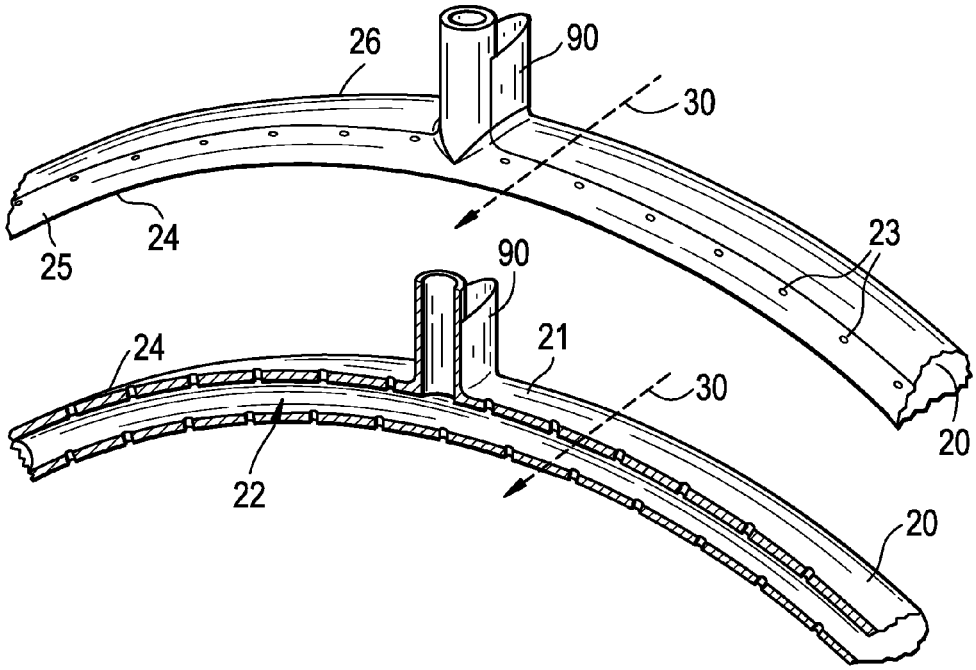
FIG. 3 is an enlarged perspective view of a body of an annular fuel manifold and an interior thereof.
Figure 4:
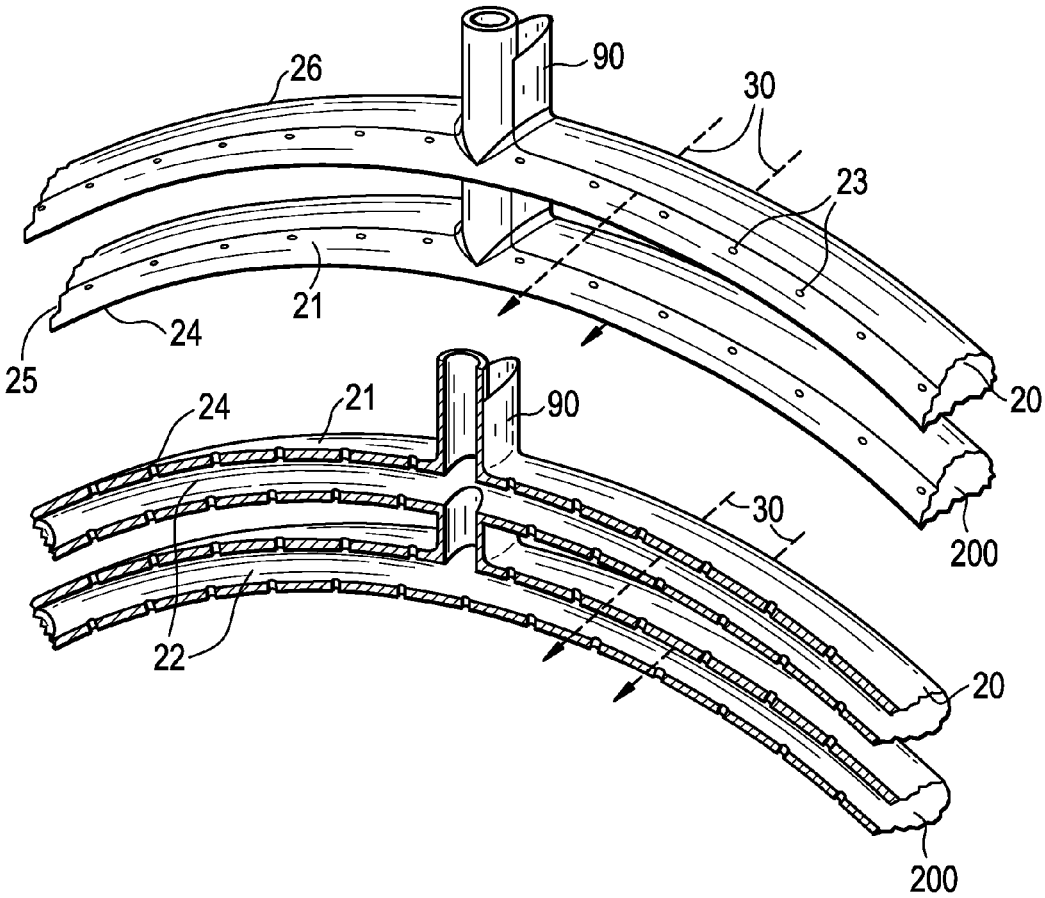
FIG. 4 is an enlarged perspective view of a body of a set of two annular fuel manifolds and interiors thereof.

With reference to FIGS. 2-4, the manifold 20 includes an annular body 21 that may, in some cases, perimetrically surround the cap assembly 50. In this way, the manifold 20 provides substantially uniform fuel distribution through its substantially uniformly located injection holes 23 to thus substantially improve the mixing of quaternary fuel with incoming air and/or a combustion fuel/air mixture within the passage 30. The manifold 20 additionally provides relatively improved fuel/air mixing through downstream combustor fuel nozzles.

The annular body 21 has a full ring-shaped casing 24 that is formed to define an interior therein with first and second opposing sides 25 and 26, at least one of which is tapered in accordance with a predominant direction of incoming fuel to reduce the trailing edge flow separation (recirculation) and, in some cases, to thereby reduce a likelihood of an occurrence of local flame-holding. The interior serves as a fuel accommodating space 22, which is sufficiently large enough to accommodate a predefined quantity of fuel. In some cases, this quantity may be up to 30%, by mass, of total combustor fuel. The body 21 is further formed to define the injection holes 23 through which fuel is injected from the fuel accommodating space 22 and into a section 31 of the passage 30. The injection holes 23 are perimetrically arrayed around the manifold 20 and may be, therefore, able to substantially uniformly distribute quaternary fuel into the passage 30 and, in particular, the section 31.

The taper of the casing 24 is defined in a direction corresponding to a predominant flow direction of the air and/or the fuel/air mixture flowing through the passage 30 at the section 31. Thus, a relatively blunt side 26 faces the oncoming flow with the tapered side 25 pointing downstream. The fuel injection holes 23 may be arrayed at various locations on the casing 24 and with varying or substantially uniform spacing from one another. In accordance with further embodiments, the fuel injection holes 23 may be formed proximate to the tapered side 25 and on radially inward and radially outward facing surfaces such that the fuel is injected into the section 31 in substantially radially inward and radially outward directions.

In accordance with still further embodiments, the fuel injection holes 23 may be disposed at radial maximum and radial minimum sections of the annular body 21.

The section 31 of the passage 30 is defined as a portion of the passage 30 at which the air and/or the fuel/air mixture flows upstream from the fuel nozzle supports 60. The section 31 may be further defined as a portion of the passage 30 at which the air and/or the fuel/air mixture flows at a relatively high local velocity measured relative to relatively low but non-zero flow velocities at other sections of the passage 30. In accordance with embodiments, the high flow velocities may be caused by various factors including, but not limited to, the width of the passage 30 being relatively narrow in some areas as compared with other areas, other aerodynamic considerations and the possible presence of additional flows.

In accordance with embodiments, the section 31 may be radially interposed between the casing 40 and the cap assembly 50. In accordance with further embodiments, the cap assembly 50 may include a baffle 70, which extends axially from an edge of the cap assembly 50. In these embodiments, the section 31 may be radially interposed between the casing 40 and the baffle 70.

The passage 30 is defined with a first leg 33 that is radially aligned with the fuel nozzle support 60 and a second leg 34 that is positioned radially outward of the fuel nozzle support 60. The second leg 34 is upstream from the first leg 33 such that the passage 30 is generally hooked inwardly with the air and/or the fuel/air mixture flowing in opposite directions along the first and second legs 33 and 34. The section 31 of the passage 30, at which the air and/or the fuel/air mixture flows, may be disposed along at least one of the first leg 33 and the second leg 34 or within a region between the legs 33 and 34 where the passage 30 is hooked.

Figure 5:
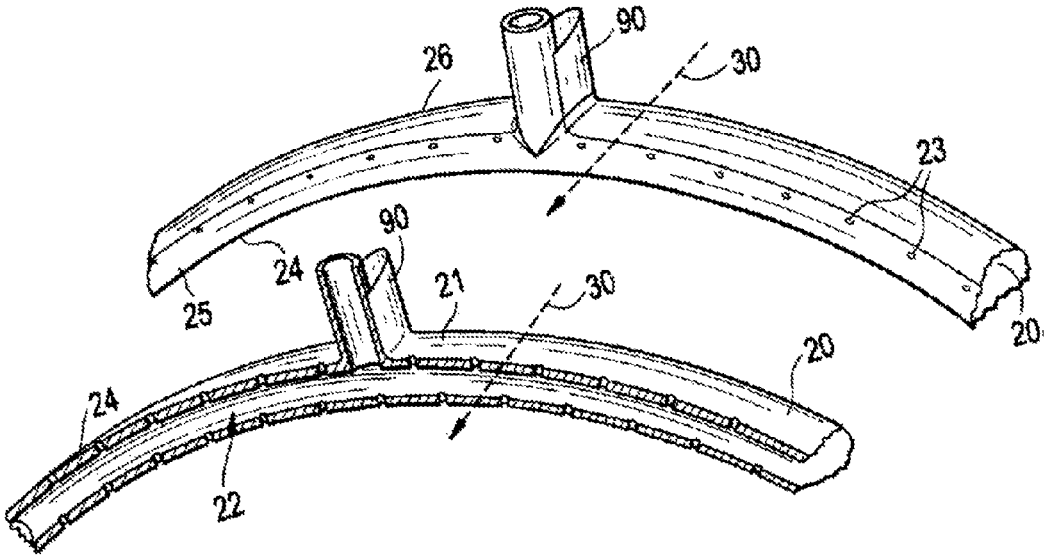
FIG. 5 is an enlarged perspective view of a body of an annular fuel manifold and an interior thereof in accordance with alternative embodiments.

As shown in FIGS. 3, 4 and 45, the manifold 20 may be singular or plural in number. Where the manifold 20 is plural, at least one manifold 20 is radially outward of another manifold 200. In accordance with embodiments, the plural manifolds 20, 200 may be substantially coaxial, although it is understood that this is not necessary and that the manifolds 20 may be axially staggered (see FIG. 5). Also, the one or more annular manifolds 20, 200 may be fueled or otherwise supplied independently of one another with differing fuels, diluents and/or steam.

Referring to FIGS. 1-4, the combustor section 10 may further include a fuel source, such as flange 80, which is disposed radially outside of an exterior surface of the quaternary fuel distribution manifold 43. The fuel line flanges 80 may be attached to a section 81 of the quaternary fuel distribution manifold 43. A substantially radially oriented supply line 90 may be formed as a component of the quaternary fuel distribution manifold 43. The supply line 90 is coupled to the fuel distribution manifold 43 and to the manifold 20 to thereby supply fuel from the fuel line flanges 80 to the manifold 20 and, more particularly, the fuel accommodating space 22 therein. The quaternary fuel distribution manifold 43 and the manifold 20 may be substantially axially aligned with one another.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor section, comprising:

one or more annular quaternary fuel manifolds mounted within a section of an annular passage defined between a casing and a cap assembly of a combustor through which air and/or a fuel/air mixture flows upstream from a fuel nozzle support, the annular passage being defined such that the air and/or the fuel/air mixture flows through the annular passage in a reverse direction radially outwardly of the fuel nozzle support and in a forward direction radially aligned with the fuel nozzle support, the section of the annular passage being provided where the air and/or the fuel/air mixture flows in the reverse direction, each manifold including a body to accommodate quaternary fuel therein, the body defining injection holes through which the quaternary fuel is injected into the section of the annular passage at an axial location upstream from the fuel nozzle support, the fuel nozzle support being one of a plurality of fuel nozzle supports and the combustor section further comprising an annular baffle extending axially from the cap assembly along a local flow direction to surround the plurality of fuel nozzle supports, the section of the annular passage being radially interposed between the casing and the annular baffle and interposed between an axial location of the fuel nozzle support and an axial location at which the air and/or the fuel/air mixture changes from flowing in the reverse direction to flowing in the forward direction.

2. The combustor section according to claim 1, wherein the one or more manifolds accommodate up to 30% by mass of total combustor fuel.

3. The combustor section according to claim 1, wherein the injection holes are perimetrically arrayed around each of the one or more manifolds.

4. The combustor section according to claim 1, wherein each of the one or more manifolds have identical cross-sectional geometries.

5. The combustor section according to claim 1, wherein the respective body of each of the one or more manifolds comprises a full ring-shaped casing.

6. The combustor section according to claim 1, wherein the respective body of each of the one or more manifolds comprises first and second opposing sides, at least one of which is tapered, the taper being aligned with an incoming flow direction.

7. The combustor section according to claim 1, wherein the one or more manifolds are plural in number and at least one of the plural manifolds is radially outward of another one of the plural manifolds.

8. The combustor section according to claim 7, wherein the one or more manifolds are fueled independently with differing fuels, diluents and/or steam.

9. The combustor section according to claim 7, wherein the one or more manifolds are axially staggered.

10. The combustor section according to claim 1, further comprising:

a fuel source; and a substantially radially oriented supply line coupled to the fuel source by which fuel is supplied from the fuel source to the space.

11. The combustor section according to claim 1, wherein the one or more annular fuel manifolds are mounted within a section of the annular passage where the air and/or the fuel/air mixture flows at a velocity that exceeds flow velocities of the air and/or the fuel/air mixture at other sections of the annular passage.

* * * * *